US005178487A

United States Patent [19]

Dresselhaus

[11] Patent Number: 5,178,487

[45] Date of Patent: Jan. 12, 1993

[54] VEHICLE SURFACE CRACKSEAL TRAIN

[76] Inventor: Donald F. Dresselhaus, 2359 Pio Pico Dr., Carlsbad, Calif. 92008

[21] Appl. No.: 702,304

[22] Filed: May 20, 1991

[51] Int. Cl.[5] ..... E01C 19/18; E01C 23/02

[52] U.S. Cl. ..... 404/107; 404/108

[58] Field of Search ..... 404/107, 111, 108, 101; 222/146

[56] References Cited

U.S. PATENT DOCUMENTS

| | | | |
|---|---|---|---|
| 1,750,104 | 3/1930 | Heltzel | 404/107 |
| 1,924,636 | 8/1933 | Burket | 404/107 |
| 3,873,227 | 3/1975 | Goethe et al. | 404/111 X |
| 4,261,669 | 4/1981 | Edo | 404/95 |
| 4,302,128 | 11/1981 | Thatcher | 404/111 |
| 4,423,980 | 1/1984 | Warnock | 404/83 |
| 5,006,012 | 4/1991 | Sterner | 404/107 |

FOREIGN PATENT DOCUMENTS

| | | | |
|---|---|---|---|
| 3720556 | 6/1986 | Fed. Rep. of Germany | 404/107 |
| 2530694 | 3/1982 | France | 404/107 |

*Primary Examiner*—Ramon S. Britts
*Assistant Examiner*—Nancy P. Connolly
*Attorney, Agent, or Firm*—Charles C. Logan, II

[57] ABSTRACT

A vehicle surface crackseal train that carries equipment for performing preliminary crack preparation, and remedial work to cracks, has equipment to apply hot and cold liquid crack sealants, and has equipment for applying particulate material to the treated cracks. The vehicle surface crackseal train has a powered vehicle that is positioned a predetermined distance ahead of the sand wagon to form a first work area between the two units. Safety barricade tractor towing beams are laterally spaced a predetermined distance and connect the rear of the powered vehicle to the front end of the sand wagon to form a first work area between the two units. Safety barricade beams are attached to the front end of the vehicle for enclosing a second predetermined work area for workmen to occupy when using equipment for repairing road surface cracks.

9 Claims, 2 Drawing Sheets

VEHICLE SURFACE CRACKSEAL TRAIN

BACKGROUND OF THE INVENTION

This invention relates to new and useful apparatus for the maintenance of pavement: Highways, airfields, hard-stands, industrial areas, marshalling yards, institutional sites and generally the infrastructure of vehicle traveled load sustaining surfaces. The invention provides new structure for solving an old problem: Cracks in the surface of pavement which allow moisture to penetrate to the base and sub-base which are subjected to pumping and flushing actions causing the affected areas to fail and become unusable. Major repair or replacement are then the only solutions for salvaging the road.

In recent years the nonavailability of funds for infrastructure maintenance has resulted in the entire highway system being place in jeopardy as becoming useless, curtailing interstate and international commerce and having a negative effect on our nation's import-export efforts.

The highway infrastructure future depends, in part, on using new techniques, new equipment and new innovative thinking to increase the speed by which each unit of work is performed, decrease the unit of work cost, increase safety and decrease liability costs. Also by increasing the ambiance of the "on highway machines", the workers pride in his equipment and his association with a modern process will increase work force production.

Infrastructure maintenance is a big business in the U.S. Cutting any of the costs in the process comes out to large cost cuts and makes more money available for desperately needed highway maintenance.

The way to accomplish this goal is to use new methods and apparatus that reduces the cost and increases safety.

Present day methods of sealing road crack surfaces differs very little from the systems used sixty years ago. Generally, one man drives a truck that pulls a liquid oil dispensing rig that pumps the liquid through a conduit to a person on the ground following the rig who uses a handwand to place the oil in the cracks. Following is a dumptruck driven in reverse by the driver. The dumptruck is loaded with particulate material such as rock-dust or sand. Often up to three men with shovels work along with this truck to service one oiler and place shovels of the material on the newly oiled cracks. This system under utilizes the manpower and results in a operation that performs work slowly and inefficiently and haphazardly.

It is an object of the invention to provide an integrated, controlled system which utilizes new apparatus which greatly increases speed, cuts costs, directs worker's energy to produce in a controlled work plan and provide a safe barricaded work area.

SUMMARY OF THE INVENTION

The vehicle surface crackseal train consists of two moving vehicles: A flatrack prime mover, herein called a crackseal wagon and a towed trailer herein called the sandgun wagon. Unlike the presently utilized system for performing cracksealing operations on road ways, the novel vehicle surface crackfill train has been designed to allow it to move in a continuous forward motion. The vehicle's operator is positioned in an offset operators cab. A conventional state of the art melter-dispenser hot liquid crack filler apparatus is mounted on the vehicle adjacent its rear end. The melter-dispenser have a novel preheater mounted on its top surface. A plurality of hot liquid application wands are connected to the hot liquid crack filler apparatus that includes its own hot oil pump and these would be utilized by workmen following the vehicle.

A series of barrels of cold liquid oil are also mounted on the vehicle and a couple of these barrels have a pump that distributes the cold liquid oil to one or more cold liquid application wands.

DESCRIPTION OF THE PREFERRED EMBODIMENT

Figure 1:
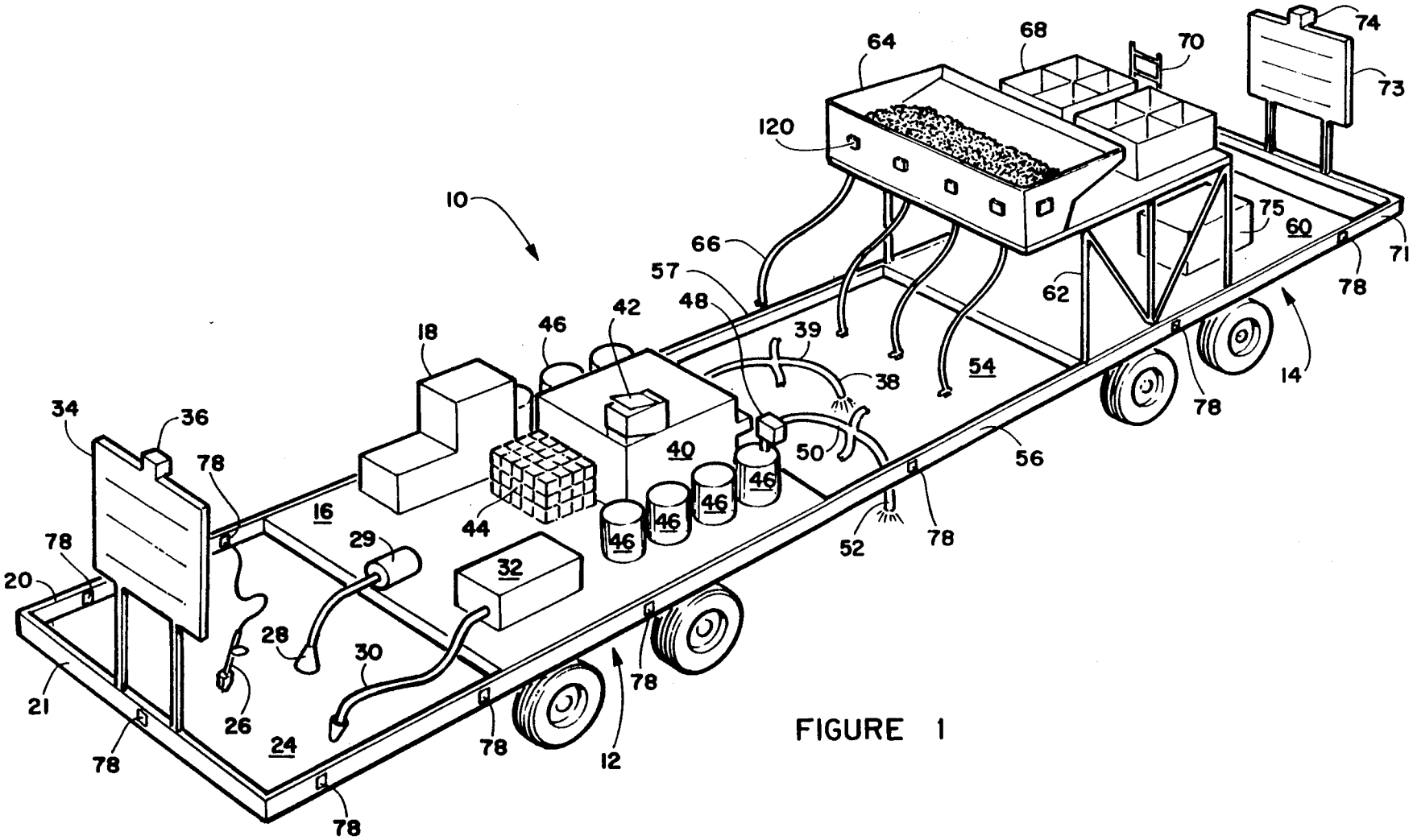
FIG. 1 is a schematic perspective view of the entire vehicle surface crackseal train.

Applicant's novel vehicle surface crackseal train will now be described by referring to FIGS. 1–6 of the drawings. The vehicle surface crackseal train is generally designated numeral 10. Its main components are crackseal wagon 12 and sand wagon 14.

Crackseal wagon 12 is a vehicle powered by a conventional engine or electrical motor. It has a frame 16 upon which its different components are mounted. An off-set operator's cab 18 is mounted adjacent one side of the frame 16. A plurality of barrier beams 20–22 are attached to each other in the front end of frame 16. They enclose the work area 24 for workmen that would operate equipment located adjacent the front end of the vehicle 12. One of the pieces of equipment operated by one of these workmen would be a router 26. Another piece of equipment operated by the workmen in work area 24 would be a heat wand 28 that is connected to propane tank 29. The third piece of equipment operated by the workmen at the front of the vehicle is a compressed air-gun 30 that is connected by conventional conduit to an air compressor 32. A state of the art safety flashing directional signal 34 is mounted on the front barrier beam 21. A revolving warning light 36 is mounted atop safety flashing directional signal 34. Standard melter-dispenser hot liquid crack filler apparatus 40 is also mounted on frame 16 adjacent its rear ends. Apparatus 40 has its own pump and it is connected to hot liquid application wand 38 by conduit 39. A preheater unit 42 (that is to be discussed later) is mounted atop unit 40. Solid crack filler material cubes 44 that would be melted in apparatus 40 and preheater unit 42 are stored on frame 16. Liquid crack filler in its cold state for cold application would be stored in containers 46. A pump 48 is connected to one of the continuous 46 and conduit 50 of the cold liquid application wands 52. Wands 38 and 52 would be used in work area 54 that is formed by tractor towing beans 56 and 57 that are connected respectively between the crackseal wagon 12 and sand wagon 14. The crackseal wagon and sand wagon could also be connected together by a fifth wheel type of towing structure that would be at an elevated height over the workers in work area 54. With this alternative structure there would still be connecting beams 56 and 57 to provide a safety barrier structure.

Sand wagon 14 has a platform frame 60 having a structural tower 62 mounted thereon. A feed bin 64 is mounted on structural tower 62. A plurality of sand guns (to be described later) have one of their ends connected to gravity flow vibrated feed bin 64. Storage bin 68 for sand or other particulate matter are also mounted on tower 62. The ladder 70 is secured to the rear end of tower 62. The safety barrier frame 71 is attached to the rear end of sand wagon 14. It has a safety flashing directional signal assembly 73 mounted thereon with a revolving warning light 74 secured to its top edge.

A generator 75 is shown mounted on sand wagon 14. It could also be mounted on vehicle 12. It would be connected by conventional electrical wires through the frame and various beams to electrical outlets 78 that have been positioned at various locations for convenience in connecting the different electrical apparatus.

Figure 2:
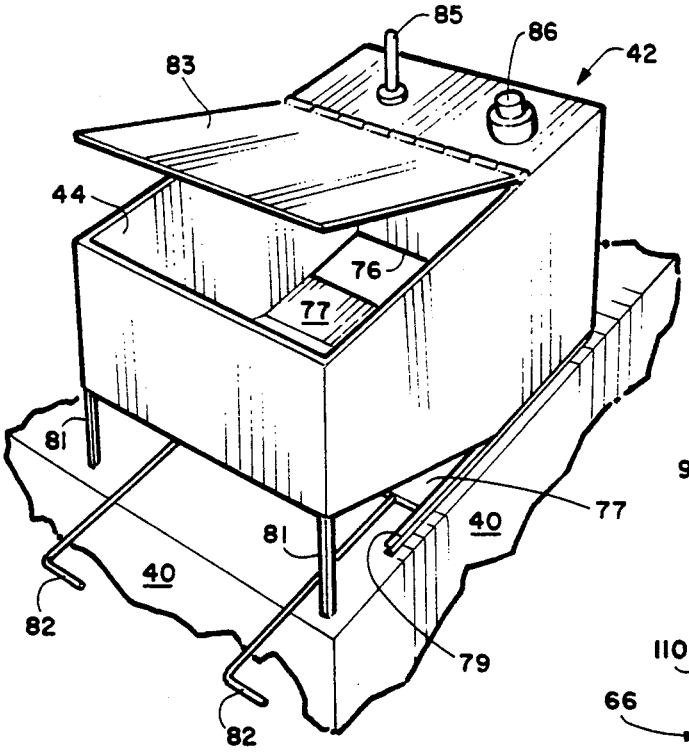
FIG. 2 is an enlarged showing of the preheater unit showing it mounted on the melter-dispenser hot liquid cracksealer apparatus.
Figure 3:
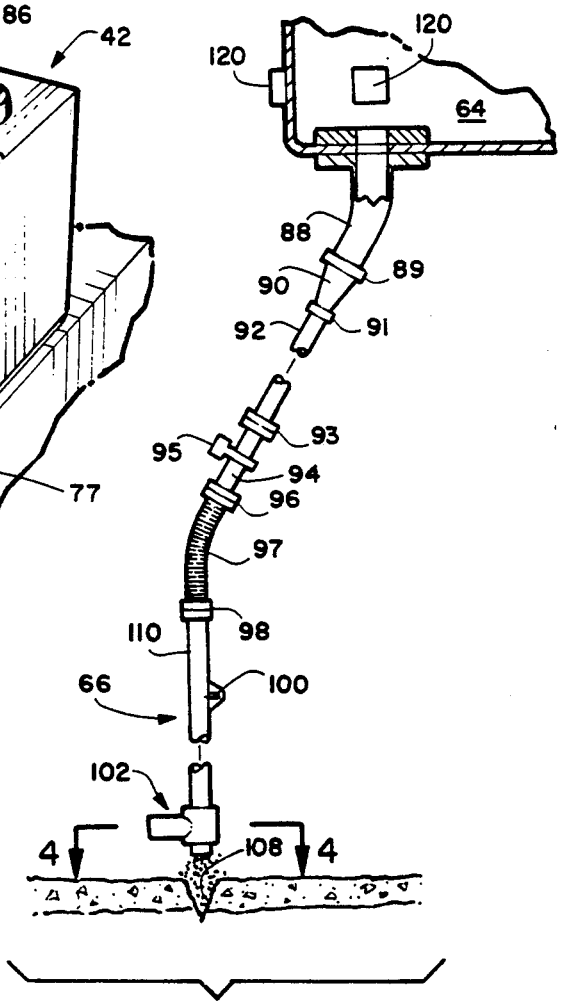
FIG. 3 is a side elevational of the sand gun and associate conduit connected to the feed bin.
Figure 4:
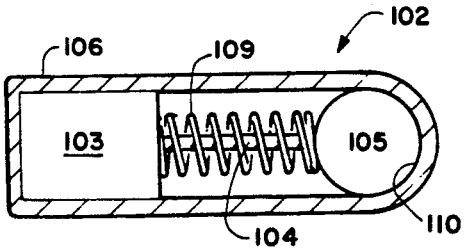
FIG. 4 is a cross sectional view taken along lines 4—4 of FIG. 3 showing the sand valve release mechanism in its closed state.
Figure 5:
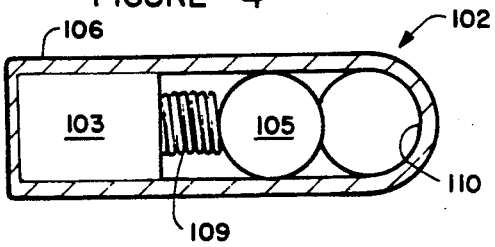
FIG. 5 is a cross sectional view showing the sand valve release mechanism in its open state.

Preheater 42 is shown in an enlarged view in FIG. 2 mounted on the melter-dispenser hot liquid crack filler apparatus 40. An opening 76 in the top of unit 40 provides communication between it and preheater 42. A sliding gate 77 has its lateral edges engaged in conventional tracking structure allows slide gate 77 to be moved from a closed position to various open positions. Dual push-pull gate operating rods 82 are accessible from the rear of preheater 42. Structural members 80 hold the bottom of preheater 42 upwardly from the top surface of unit 40 to provide a sloped surface for the melted oil from solid crack filler material cubes to run downwardly into opening 76. Slide gate rails 79 provide structure for allowing the slide gate 77 to be slid open and closed. The sealing lid 83 is pivotally hinged to the top of preheater 42 and it is pivoted upwardly to allow solid crack filler material cubes 44 to be loaded therein. Legs 81 support one end of preheater 42 a thermometer 85 and a safety relief valve 86, are mounted on the top of preheater 42.

Figure 6:
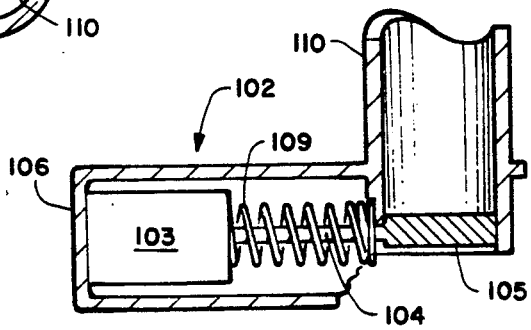
FIG. 6 is a vertical cross sectional view showing the housing for the sand valve release mechanism attached to the bottom end of the sand gun.

One of the sand guns 66 is illustrated in FIGS. 3–6. Its top end is connected by conventional structure to feed bin 64. Illustrated is a short length of conduit 88 and a connector 89 on its bottom end. Attached thereto is an eccentric reducer 90 having a connector 91 on its bottom end. A rigid conduit 92 has its top end attached to couplings 91 and its bottom end attached to coupling 93. The second eccentric reducer 94 has a vibrator assembly 95 mounted thereon. Connector 96 secures eccentric reducer 94 and flexible conduit 97 together. Connector 98 attaches to flexible conduit 97 and sand gun 66 which has an operator activated control switch 100. Control switch is connected by electrical wires to vibrator 95 and feed bin vibrators 120 and control gate valve 102 to operate simultaneously. A solenoid 103 has an actuator rod 104 that is connected to flow control gate 105 and they are mounted in housing 106. When switch 100 is actuated control gate 105 is moved to the position illustrated in FIG. 5 to release the sand into a hypothetical pavement crack 108. A spring 109 returns control gate 105 to a closed position when switch 100 is turned off. FIG. 6 is a vertical cross sectional view of housing 106 connected to pipe 110 of sand gun 99.

What is claimed is:

1. A vehicle surface crackseal train comprising:

a powered vehicle having a front end, a rear end, a left side and a right side;

a melter-dispenser hot liquid crack filler apparatus mounted on said vehicle;

means for dispensing hot liquid crack filler from the rear of said powered vehicle;

a sandwagon having a front end, a rear end, a left side and a right side;

said sandwagon being spaced a predetermined distance behind said powered vehicle to form a first work area between the two units for workmen to walk within and to operate said means for dispensing hot liquid crack filler, safety barricade means laterally enclosing said first work area, said safety barricade means being in the form of a pair of laterally spaced connecting beams each having a front end that is connected to the rear end of said power vehicle and each having a rear end that is connected to the front end of said sandwagon;

a sand feed bin mounted on said sandwagon; and means for dispensing said particulate matter being connected to said sand feed bin so that sand can be dispensed at various places in said first work area.

2. A vehicle surface crackseal train as defined in claim 1 further comprising means for repairing road surface cracks mounted on the front of said vehicle.

3. A vehicle surface crackseal train as recited in claim 2 further comprising safety barricade means attached to the front end of said vehicle for enclosing a predetermined second work area for workmen to walk within and to occupy when using said means for repairing road surface cracks.

4. A vehicle surface crackseal train as recited in claim 3 further comprising first warning light means at the front of said vehicle for protecting it against oncoming traffic.

5. A vehicle surface crackseal train as defined in claim 1 further comprising second warning light means at the rear of said vehicle for protecting it against following traffic.

6. A vehicle surface crackseal train as defined in claim 1 further comprising preheater means for providing continuous hot sealing liquid for said melter-dispenser hot liquid crack filler apparatus.

7. A vehicle surface crackseal train as defined in claim 1 wherein said sand storage housing is mounted on a structural tower to provide an elevated feed bin for said means for dispensing sand.

8. A vehicle surface crackseal train as defined in claim 7 wherein particulate material from said elevated feed bin is fed to said first work area by gravity and by means for vibrating said particulate material.

9. A vehicle surface crackseal train comprising:

a powered vehicle having a front end, a rear end, a left side and a right side;

a container of cold liquid oil mounted on said vehicle;

means for dispensing cold liquid oil from the rear of said vehicle;

a sandwagon having a front end, a rear end, a left side and a right side;

said sandwagon being spaced a predetermined distance behind said powered vehicle to form a first work area between the two units for workmen to walk within and to operate said means for dispensing cold liquid oil, safety barricade means laterally enclosing said first work area, said safety barricade means being in the form of a pair of laterally spaced connecting beams each having a front end that is connected to the rear end of said powered vehicle and each having a rear end that is connected to the front end of said sand wagon;

a sand storage housing mounted on said sandwagon, and means for dispensing particulate matter being connected to said sand storage housing so that sand can be dispensed at various places in said first work area.

* * * * *